US008997829B2

(12) United States Patent
Kao

(10) Patent No.: US 8,997,829 B2
(45) Date of Patent: Apr. 7, 2015

(54) ROLLER BLINDS CONTROLLER STRUCTURE

(71) Applicant: Uni-Soleil Ent. Co., Ltd., Tainan (TW)

(72) Inventor: Yu-Ting Kao, Tainan (TW)

(73) Assignee: Uni-Soleil Ent. Co., Ltd., Tainan (TW)

( * ) Notice: Subject to any disclaimer, the term of this patent is extended or adjusted under 35 U.S.C. 154(b) by 29 days.

(21) Appl. No.: 13/886,545

(22) Filed: May 3, 2013

(65) Prior Publication Data

US 2014/0041815 A1 Feb. 13, 2014

(30) Foreign Application Priority Data

Aug. 8, 2012 (TW) ..... 101215275 U

(51) Int. Cl.

| | |
|---|---|
| ***E06B 9/56*** | (2006.01) |
| ***E06B 9/44*** | (2006.01) |
| ***E06B 9/42*** | (2006.01) |
| ***E06B 9/78*** | (2006.01) |
| *E06B 9/90* | (2006.01) |

(52) U.S. Cl.

CPC ... *E06B 9/44* (2013.01); *E06B 9/42* (2013.01); *E06B 9/78* (2013.01); *E06B 2009/785* (2013.01); *E06B 2009/905* (2013.01)

(58) Field of Classification Search

USPC ..... 160/321
IPC ..... E06B 7/78
See application file for complete search history.

(56) References Cited

U.S. PATENT DOCUMENTS 4,751,953 A * 6/1988 Appel et al. ..... 160/313

FOREIGN PATENT DOCUMENTS

| | | |
|---|---|---|
| TW | 395220 U | 6/2000 |
| TW | 428468 U | 4/2001 |
| TW | 579803 U | 3/2004 |

* cited by examiner

*Primary Examiner* — Blair M Johnson
(74) *Attorney, Agent, or Firm* — Rosenberg, Klein & Lee

(57) ABSTRACT

An improvement of roller blinds controller is provided, it mainly comprises a cylindrical rod passing through a side cover and fixing therewith; a bead chain sprocket and a number of torsion springs fitted on the cylindrical rod, and an outer sleeve cover fitted on the outside, wherein: the cylindrical rod has a ridge portion protruded from the circumferential surface thereof, while the side cover has a has a central aperture with a annular edge portion, the cylindrical rod can be fixed with the side cover by the snap-fitting of the annular edge portion between the flange portion and the ridge portion.

2 Claims, 4 Drawing Sheets

ROLLER BLINDS CONTROLLER STRUCTURE

BACKGROUND OF THE INVENTION

1. Field of the Invention

This invention relates to an improvement of roller blinds controller, more particularly to a roller blinds controller easy in locating and assembling purpose, in which a ridge portion is provided on limiting rod for secure fixing so as to achieve the purpose of easy assembling.

2. Brief Description of the Prior Art

Conventional window curtain structure, other than window blinds and horizontal draw-pull window covering, still has a roller blinds structure enabling to roll up and down in vertical direction. Ordinary roller blinds structure substantially has a controller provided at one end of a roller tube on which a rolling fabric is rolled up. Two side brackets are respectively provided at the other end of the roller tube and the head end of the controller. Meanwhile, a pulling cord, usually a bead chain, is provided on the controller, and whereby up-down of the fabric, upon pulling of the cord by users, can be controlled by the controller and the rolling fabric can be stopped at any intermediate position as desired by users.

Conventional roller blinds structures have been proposed, such as Taiwanese Patent Gazette No. 395220 entitled "A roller blind controller", No. 428468 entitled "A spring structure adapted to roller blinds controller", or No. 579803 entitled "Improvement of roller blinds controller structure". Each of theses structures is substantially formed, as depicted in FIG. 4, by a limiting rod (71), a sleeve cover (72), a side cover (73), and an outer sheath (74). The limiting rod (71) has an inserting segment at one end, and an open slot (711) and an engaging protrusion (712) at the other end thereof. A bead chain sprocket (721) for meshing a bead chain (75) is fitted on the inserting segment, and one end of the bead chain sprocket (721) is connected to the sleeve cover (72) which is rotated simultaneously upon the pulling of the bead chain (75). The sleeve cover (72) has a hollowed portion (722) the two edges of which are abutted by the two ends of a torsion spring (76) fitted on the limiting rod (71). Finally, an outer sheath (74) is assembled in such a manner that the engaging protrusion (712) of the limiting rod (71) is snap-fitted on the outer sheath (74); thereby a roller blinds controller (7) is completed. In the assembly process of the above structure, when the limiting rod (71) is inserted through the side cover (73), it is only in free state without being positioned in place so that the limiting rod (71) is in a state of possibly coming off the side cover (73). Even after the subsequent fitting of the sleeve cover (72) and the torsion spring (76), all the members are in unseated messy state until the outer sheath (74) is assembled to be snap-fitted with the engaging protrusion (712) of the limiting rod (71). Thus, the assembly is inconvenient.

SUMMARY OF THE INVENTION

The main object of this invention is to provide a roller blinds controller, the assembly process of which can be simplified by the provision of a ridge portion on the rod body for snap-fitting with side cover.

The object and effect of the improvement of roller blinds controller of the present invention is achieved by the following technical content.

The roller blinds controller is mainly formed by a cylindrical rod for passing through the central aperture of the side cover and fixing therewith; a bead chain sprocket meshing with a bead chain and fitted on the cylindrical rod; a number of torsion springs located between the cylindrical rod and the bead chain sprocket; and an outer sleeve cover fixed on the outside, wherein: the cylindrical rod has a ridge portion protruded from the circumferential surface thereof, while the side cover has a central aperture with annular edge portion, the cylindrical rod can be fixed with the side cover by the snap-fitting of the annular edge portion between the flange portion and the ridge portion.

According to the improvement of roller blinds controller as stated above, the cylindrical rod has a flange portion to be integral with the rod body of the cylindrical rod, the rod body having a ridge portion formed on the circumferential surface thereof, the side cover having a recessed portion corresponding to the flange portion of the cylindrical rod, the annular edge portion of the central aperture formed at the inner side of the recessed portion being snap-fitted between the flange portion of the cylindrical rod and the ridge portion.

According to the improvement of roller blinds controller as stated above, an arc fillet surface is formed at the junction between the flange portion and the rod body, so that the strength of the cylindrical rod can be reinforced thereby.

DETAILED DESCRIPTION OF PREFERRED EMBODIMENT

Figure 1:
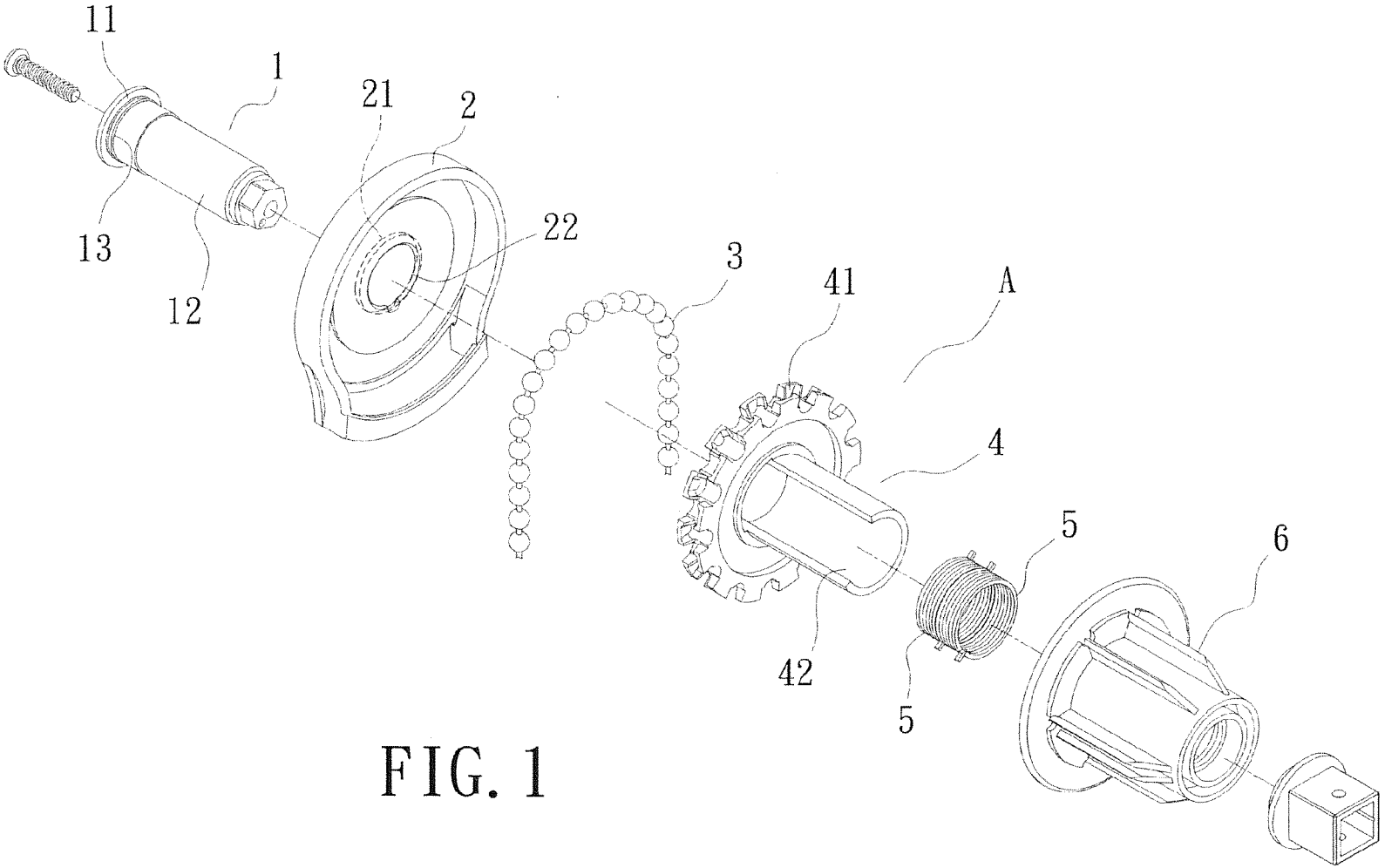
FIG. 1 is an overall schematic exploded view of the present invention.
Figure 2:
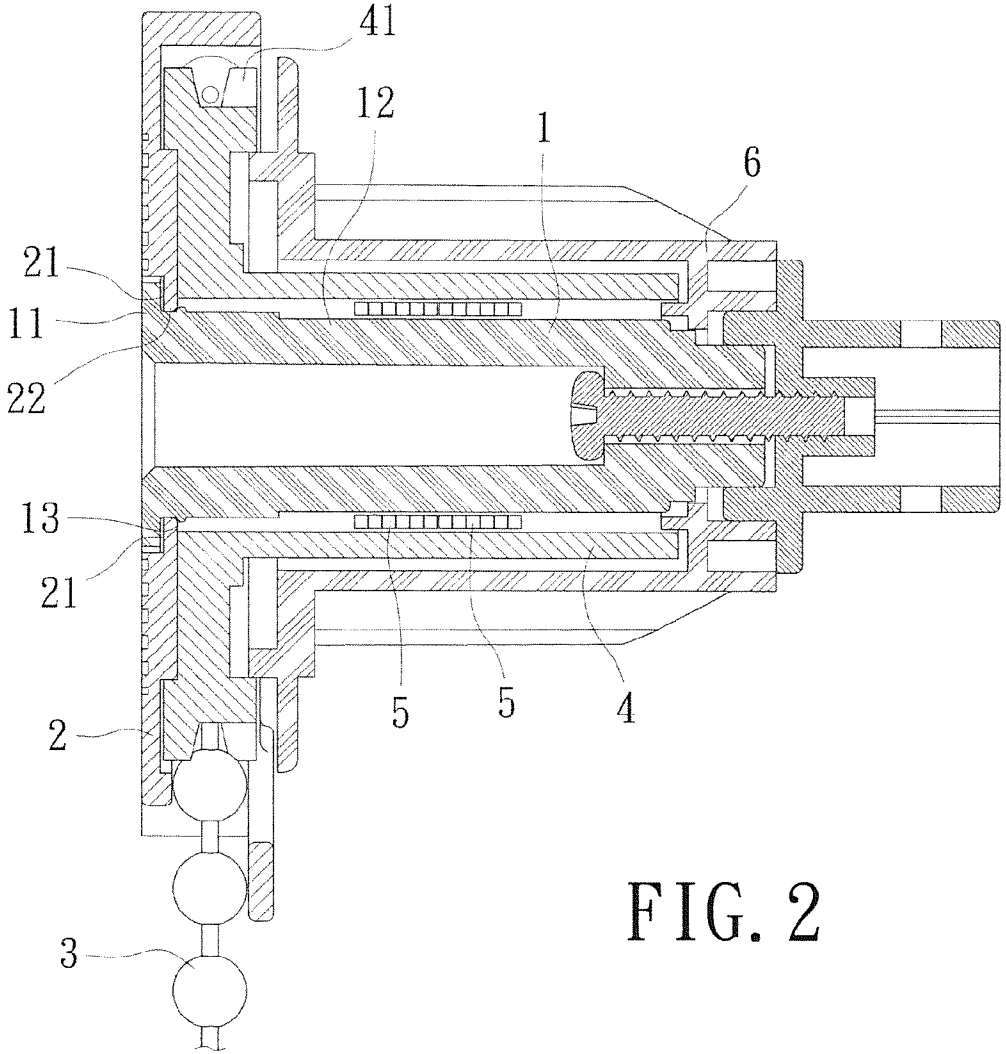
FIG. 2 is a schematic sectional view of the present invention.
Figure 3:
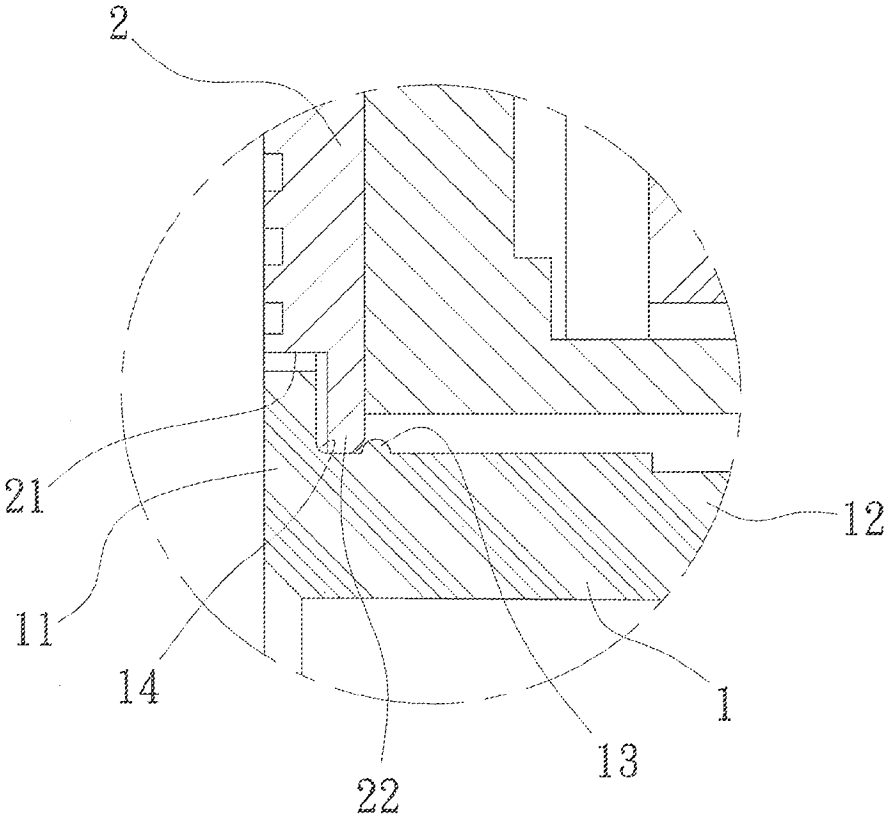
FIG. 3 is a partially enlarged schematic view of the present invention.
Figure 4:
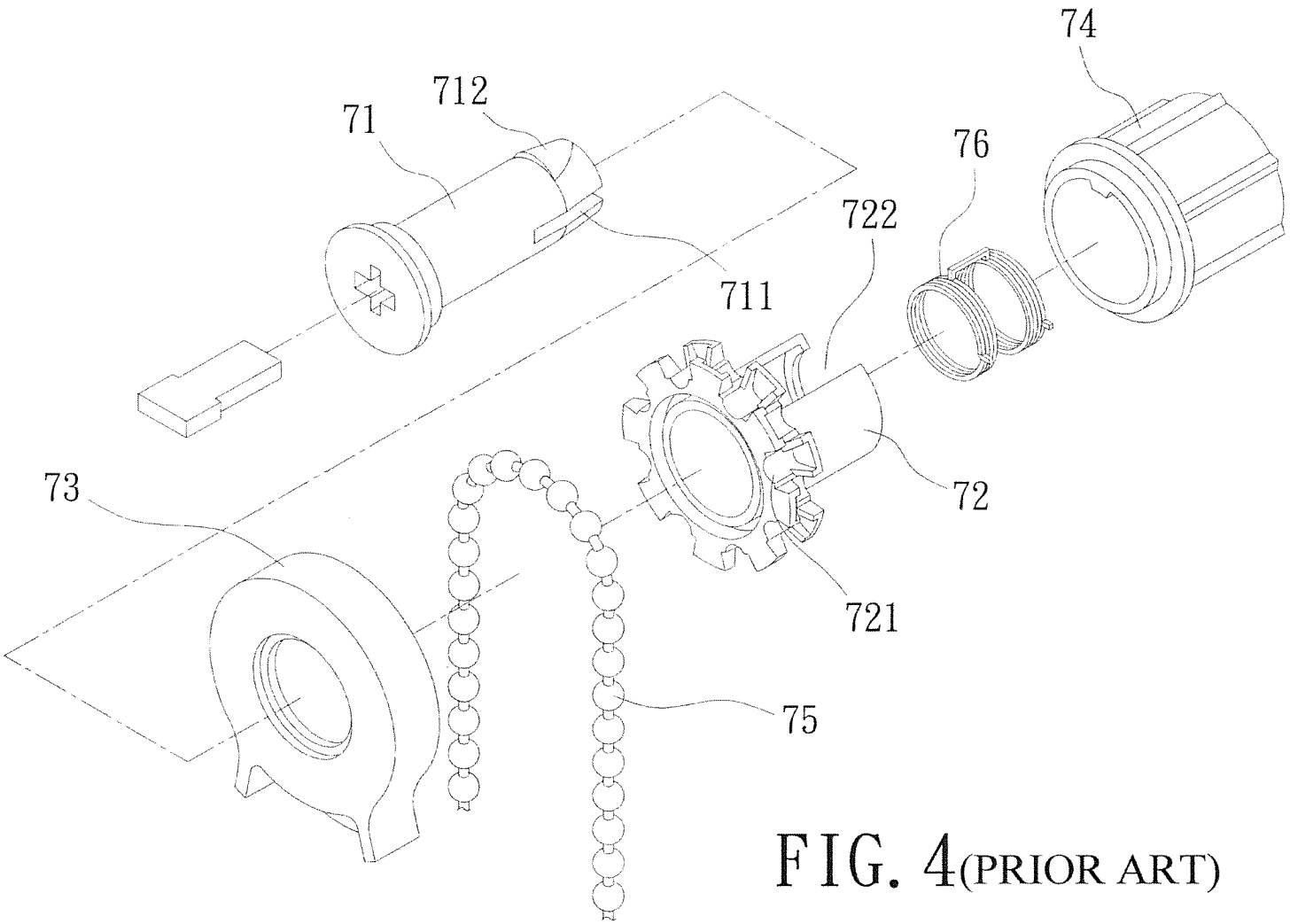
FIG. 4(PRIOR ART)
FIG. 4 is a schematic view of prior art.

Firstly, referring to FIGS. 1 to 3 representing respectively an overall exploded view and schematic sectional view of the present invention, the roller blinds controller (A) of the present invention is mainly formed by a cylindrical rod (1) passing through the central aperture of a side cover (2) and fixing therewith, a bead chain sprocket (4) meshing with a bead chain (3) and fitted on the cylindrical rod (1), and a number of torsion springs (5) located between the cylindrical rod (1) and the bead chain sprocket (4), and an outer sleeve cover (6) fitted on the outside.

The cylindrical rod (1) has a flange portion (11) that is integral with the rod body (12) of the cylindrical rod (1). The rod body (12) has a ridge portion (13) protruded from the circumferential surface thereof. The side cover (2) has a recessed portion (21) corresponding to the flange portion (11) of the cylindrical rod (1). The annular edge portion (22) of the central aperture formed at the inner side of the recessed portion (21) is snap-fitted between the flange portion (11) and the ridge portion (13) of the cylindrical rod (1).

When assembling the roller blinds controller (A), as shown in FIGS. 1 to 3, the cylindrical rod (1) is inserted through the central aperture of the side cover (2) in such a manner as to allow the annular edge portion (22) of the recessed portion (21) being snap-fitted between the flange portion (11) and the ridge portion (13) of the cylindrical rod (1). Meanwhile, the flange portion (11) is mated in the recessed portion (21) of the side cover (2) to be flusher therewith. Thereafter, the bead chain sprocket (4) is fitted on the rod body (12) of the cylin drical rod (1) and the bead chain (3) is meshed on the radial grooves (41) formed on the outer periphery of the bead chain sprocket (4). Several torsion springs (5) are fitted on the rod body (12) of the cylindrical rod (1) and are located within the hollowed portion (42) of the bead chain sprocket (4). Finally, the outer sleeve cover (6) is fitted on the outside so as to form the roller blinds controller (A). The provision of ridge portion (13) on the rod body (12) for positioning and fixing can facilitate the assembly of the roller blinds controller.

According to a preferred embodiment of the present invention, an arc fillet surface 14 is formed at the junction between the flange portion and the rod body, so that the strength of the cylindrical rod can be reinforced.

Based on the foregoing description of the constitution and the implementation of the present invention, the present invention has the following advantages when comparing with conventional structures.

1. In the improvement of roller blinds controller of the present invention, the cylindrical rod can be fixed directly with the side cover by the snap-fitting of the annular edge portion of the side cover against the ridge portion. Therefore, the assembly process can be simplified.
2. In the improvement of roller blinds controller of the present invention, an arc fillet surface is formed at the junction between the flange portion and the rod body, the strength of the cylindrical rod can be reinforced.

What is claimed is:

1. An improvement of roller blinds controller, said roller blinds controller is mainly formed by a cylindrical rod having a first end and a second end, said second end of said cylindrical rod passing through the central aperture of a side cover and fixing therewith, a bead chain sprocket meshing with a bead chain and fitted on the cylindrical rod, and a number of torsion springs located between the cylindrical rod and the bead chain sprocket, and an outer sleeve cover fitted on the outside, said cylindrical rod, comprising:

a flange portion integrally formed on said first end of the cylindrical rod, said cylindrical rod having a ridge portion protruding from the circumferential surface of the first end thereof, said side cover having a recessed portion corresponding to said flange portion of said cylindrical rod; and an annular edge portion of the central aperture formed at the inner side of said recessed portion being snap-fitted to matingly engage said flange portion of said cylindrical rod and said ridge portion.

2. The improvement of roller blinds controller as claimed in claim 1, wherein an arcuately contoured fillet surface for reinforcement is formed at the junction between said flange portion and said cylindrical rod.

* * * * *